US006043439A

United States Patent [19]

Crooks et al.

[11] Patent Number: 6,043,439

[45] Date of Patent: Mar. 28, 2000

[54] SLIDE BAR INTERLOCK

[75] Inventors: William M. Crooks; David K. Haag, both of Sumter, S.C.; Robert Walker Mitchell, Flower Mound, Tex.

[73] Assignee: Eaton Corporation, Cleveland, Ohio

[21] Appl. No.: 09/350,850

[22] Filed: Jul. 9, 1999

[51] Int. Cl.[7] ..... H01H 9/20

[52] U.S. Cl. ..... 200/50.33; 200/50.32

[58] Field of Search ..... 200/50.32, 50.33, 200/43.16

[56] References Cited

U.S. PATENT DOCUMENTS

| | | | |
|---|---|---|---|
| 3,705,280 | 12/1972 | Harms | 200/50 C |
| 4,286,242 | 8/1981 | Mrenna et al. . | |
| 4,924,041 | 5/1990 | Yee | 200/50 C |
| 5,008,499 | 4/1991 | Yee et al. | 200/50 C |
| 5,397,868 | 3/1995 | Smith et al. . | |
| 5,436,415 | 7/1995 | Smith et al. . | |

*Primary Examiner*—Michael L. Gellner
*Assistant Examiner*—Nhung Nguyen
*Attorney, Agent, or Firm*—Martin J. Moran

[57] ABSTRACT

An apparatus for interlocking horizontally adjacent first and second circuit breakers and preventing the circuit breakers from simultaneously being in a closed operating position. The circuit breakers each have a pivotable actuating handle movable between a closed position which is proximal to the other circuit breaker, and a open position which is distal to the other circuit breaker. A housing lies between the first and second circuit breakers and an interlock bar is slidably retained in the housing. In operation, the interlock bar is slidable between a first position where the interlock bar prevents the first circuit breaker handle from pivoting into the closed position and a second position where the interlock bar prevents the second circuit breaker handle from pivoting into the closed position. If the interlock bar is in the first position and the handle of the second circuit breaker is in the closed position, the handle of the second circuit breaker prevents the interlock bar from being moved into the second position. To move the interlock bar into the second position, the user must move the handle of the second circuit breaker into the open position. Once the handle of the second circuit breaker is in the open position, the interlock bar can be moved into the second position and the handle of the first circuit breaker may be closed. While the interlock bar is in the second position and the handle of the first circuit breaker is in the closed position, the handle of the first circuit breaker prevents the interlock bar from being moved into the first position.

40 Claims, 8 Drawing Sheets

SLIDE BAR INTERLOCK

BACKGROUND OF THE INVENTION

1. Field of the Invention

This invention relates to devices which interlock circuit breakers to preclude two circuits from being closed simultaneously. Specifically, this invention relates to a slidable interlock device positioned between two circuit breakers which are mounted horizontally and oriented so that the closed position of each circuit breaker handle is proximal to the other circuit breaker.

2. Background Information

There are a number of applications where it is required that the operation of two circuit breakers be coordinated such that only one circuit breaker can be in the closed, operating position at one time. One such application is providing a power-consuming load with electrical power from either of two different sources, such as a commercial power system and an auxiliary supply. It is imperative in such applications that only one circuit breaker be in the closed, operating position at one time.

U.S. Pat. No. 4,286,242 discloses an interlock utilizing plungers which engage the internal operating mechanisms of the circuit breaker. In this interlock, which is designed for use with SPB type circuit breakers, the plunger of a first circuit breaker to be closed, engages a lever on a rod to rotate the rod about its axis. Another lever on the other end of the rod engages a push rod which holds the second circuit breaker in the trip-free condition. An identical mechanism engaged when the second breaker is closed, holds the first circuit breaker in the trip-free condition. Thus, two complete mechanisms are required so that any attempt to close one circuit breaker while the other is closed, returns the open circuit breaker to the trip-free condition.

Other interlocks are known which couple the actuating means, for example, operating handles, of circuit breakers whose operation is to be coordinated. Typically, the circuit breakers and the type of actuating means employed by the circuit breakers are similar if not identical. For example U.S. Pat. No. 5,397,868 discloses a transfer switch for a pair of circuit breakers. As disclosed, the circuit breakers are mounted vertically, each breaker having an actuating handle traveling between an upper, closed position and a lower, open position. The transfer switch ensures that only one actuating handle may be in the upper, closed position at one time.

As disclosed in U.S. Pat. No. 5,397, 868, circuit breakers for industrial applications are typically mounted in a vertical relation to each other. In this configuration the closed, operating position of each circuit breaker is traditionally when the circuit breaker actuating handle is in the higher position. This configuration requires more space than a circuit breaker panel where the circuit breakers are aligned horizontally adjacent to each other with the closed, operating position of the circuit breaker handle being proximal to the center line between the pairs of circuit breakers. Interlock devices are typically limited to working with circuit breakers that have their operating position in the same direction.

One common circuit breaker configuration has a rectangular body and a pivoting, actuating handle mounted medially thereon. The actuating handle travels in a direction parallel to the longer sides of the rectangular circuit breaker body. As such, when circuit breakers are mounted in pairs, with the switches operating in the vertical direction (typically with the upward position being the closed, operating position), the circuit breakers will require more room than circuit breakers which are mounted so that the switches travel in the horizontal direction. To save space in circuit breaker panels, it is not uncommon to mount rectangular circuit breaker pairs with their longer sides running horizontally. When oriented in this manner, the operating switches travel in an arcuate path in the horizontal plane, where the closed position is toward the other circuit breaker. Unlike vertically mounted circuit breaker pairs, the closed position of each circuit breaker is in the opposite direction of the other circuit breaker in the pair. That is, a pair of circuit breakers, one laying on the left of the center line and one laying on the right of the center line, each have actuating switches which are operable in the opposite direction from each other i.e., the left circuit breaker will be operable when the actuating handle is in the right position whereas, the right circuit breaker will be operable when the actuating handle is in the left position.

Because circuit breaker interlock devices in the prior art are designed to prevent circuit breaker actuating handles from being disposed in the same direction simultaneously, there is a need for an interlock device which will prevent the actuating handles of a horizontally mounted circuit breaker pair, which are oriented so that the actuating handles are in the closed, operating position when the circuit breaker actuating handle is proximal to the other circuit breaker, from being in the closed, operating position simultaneously.

There is also a need for an interlock device which may be utilized with existing circuit breaker designs with minimal or no modifications to the existing circuit breakers.

There is also a need for an interlock device which may be used with either one-pole circuit breakers, two-pole circuit breakers or three-pole circuit breakers.

SUMMARY OF THE INVENTION

These and other needs are satisfied by the invention which is directed to an interlock for a pair of circuit breakers each utilizing a pivoting, actuating handle oriented so that the closed, operating position of one such circuit breaker handle is proximal to the other circuit breaker which are prevented from being simultaneously in the closed, operating position by a slide bar interlock for interlocking the adjacent circuit breakers.

The slide bar interlock includes a housing which encloses an interlock bar. Preferably, the housing means is positioned between the adjacently located first and second circuit breakers. The interlock bar has a first end projecting from the housing toward to the first circuit breaker and a second end projecting from the housing toward the second circuit breaker. The interlock bar is slidable between a first position and a second position. When the interlock bar is located in the first position, the first end of the interlock bar locks the operation of the pivoting handle of the first circuit breaker. Similarly, when the interlock bar is located in the second position, the second end of the interlock bar prevents the operation of the pivoting handle of the second circuit breaker. The interlock bar travels in a plane which lays perpendicular to the plane of travel of each actuating handle.

BRIEF DESCRIPTION OF THE DRAWINGS

A full understanding of the invention can be gained from the following description of the preferred embodiments when read in conjunction with the accompanying drawings in which:

FIG. 4B shows the interlock assembly in a second position.

FIG. 5B shows the interlock assembly in a second position.

DESCRIPTION OF THE PREFERRED EMBODIMENT

Figure 1:
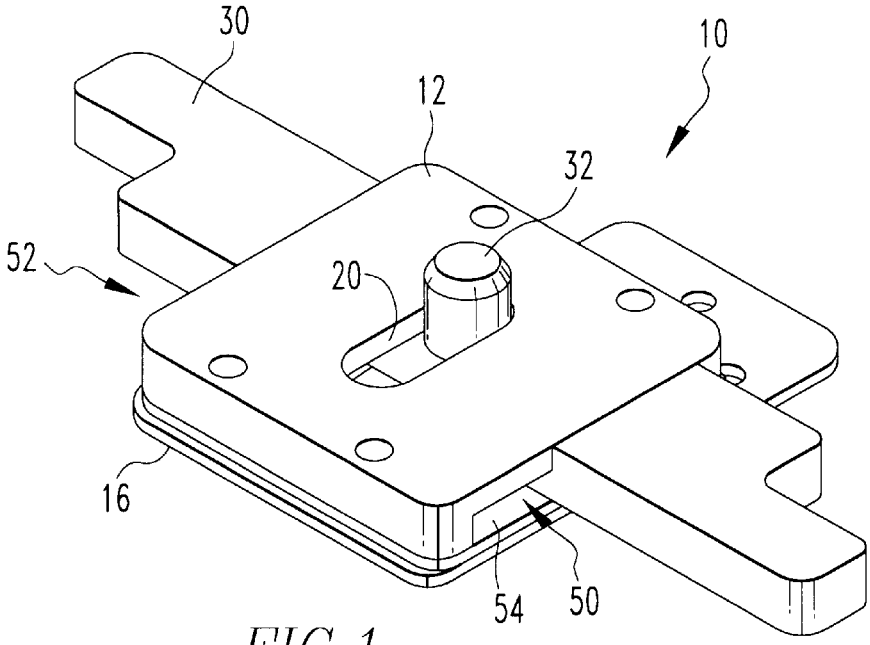
FIG. 1 is a perspective view of the interlock assembly.
Figure 3:
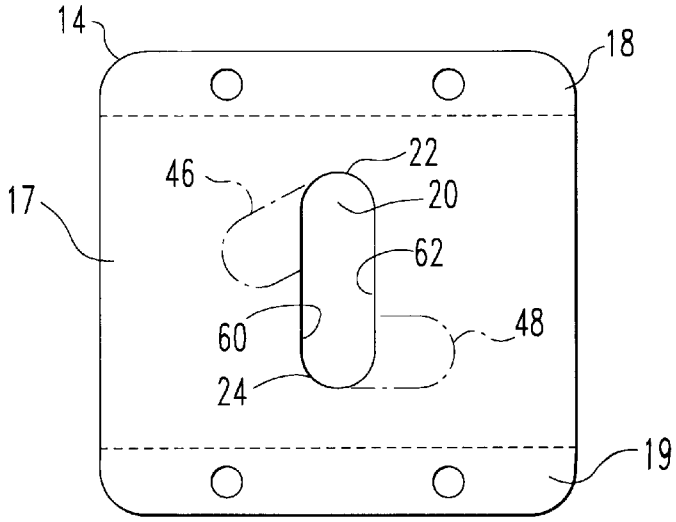
FIG. 3 is a top view of the face plate.

Referring to FIG. 1, there is shown a slide bar circuit breaker interlock assembly 10 of the preferred embodiment of the present invention. The interlock assembly 10 is made from a housing 12 which encloses an interlock bar 30. As shown in FIG. 2, the housing 12 is made from a face plate 14 which has a U-shaped cross-section and a back plate 16. As shown in FIG. 3, the U-shaped face plate is formed of a generally flat plate 17 with two ridge-like ends 18, 19 extending in the same direction, substantially 90 degrees to the flat plate 17. The back plate 16 has a tab 85 with fastener holes 86, 87, 88 passing therethrough. The U-shaped face plate 14 is held by fasteners 80 with the ends 18, 19 contacting the back plate 16, thus forming a housing cavity 50. As shown in FIG. 1, when attached to the back plate 16, the inverted U-shaped face plate 14 allows the housing 12 to have a first opening 52 (not shown), and a second opening 54 connecting the cavity 50 with the environment. The face plate 14 has a slot 20 passing therethrough. As shown in FIG. 3, the slot 20 has first end 22 and a second end 24. In the preferred embodiment, the slot 20 runs in a direction generally between face plate ends 18, 19.

Figure 2A:
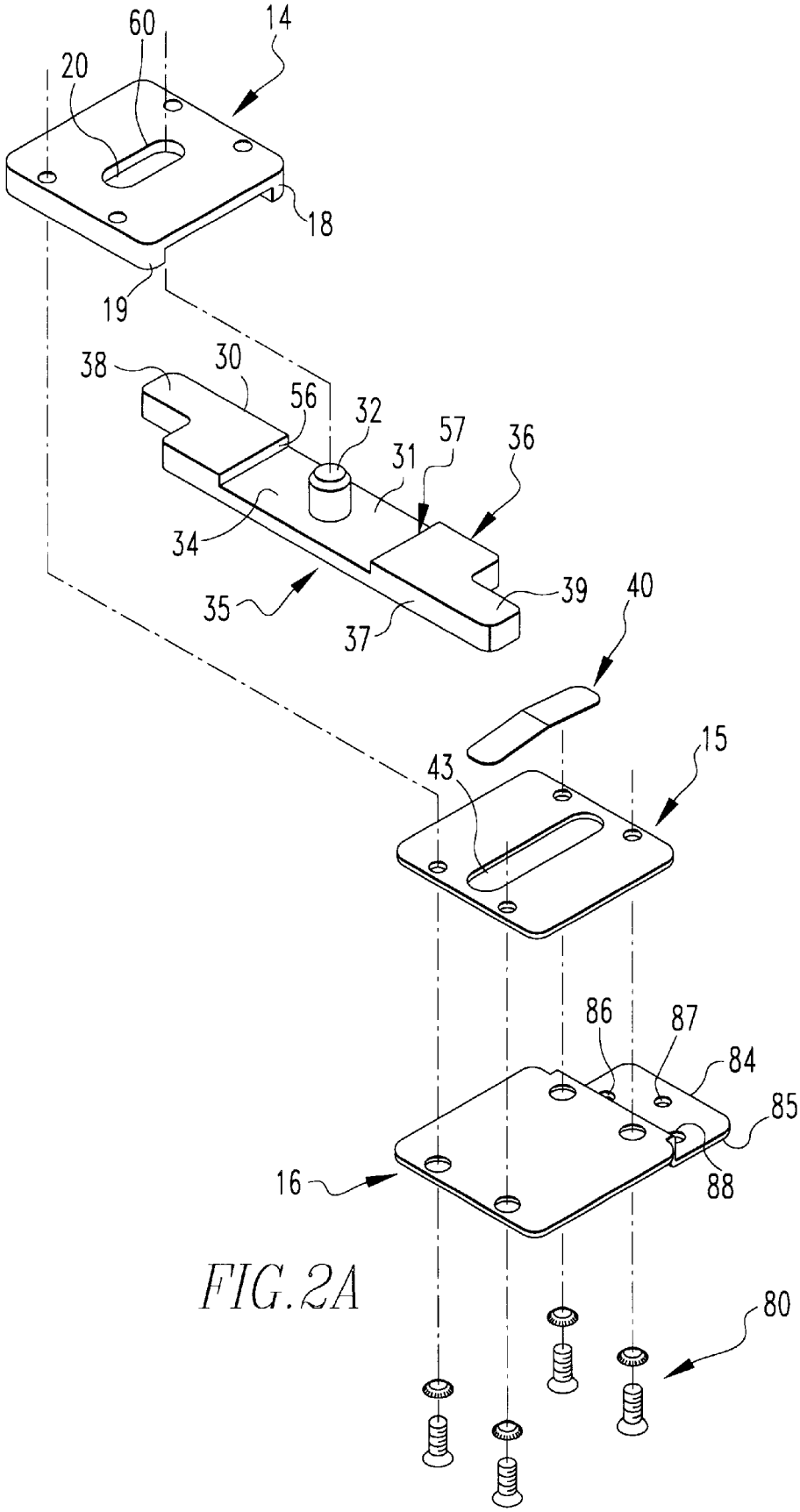
FIGS. 2A and 2B are an exploded view showing the interlock assembly, specifically, 2A shows the assembly with an intermediate plate having a slot, 2B shows an alternate embodiment where the back plate has a recess.
Figure 2B:
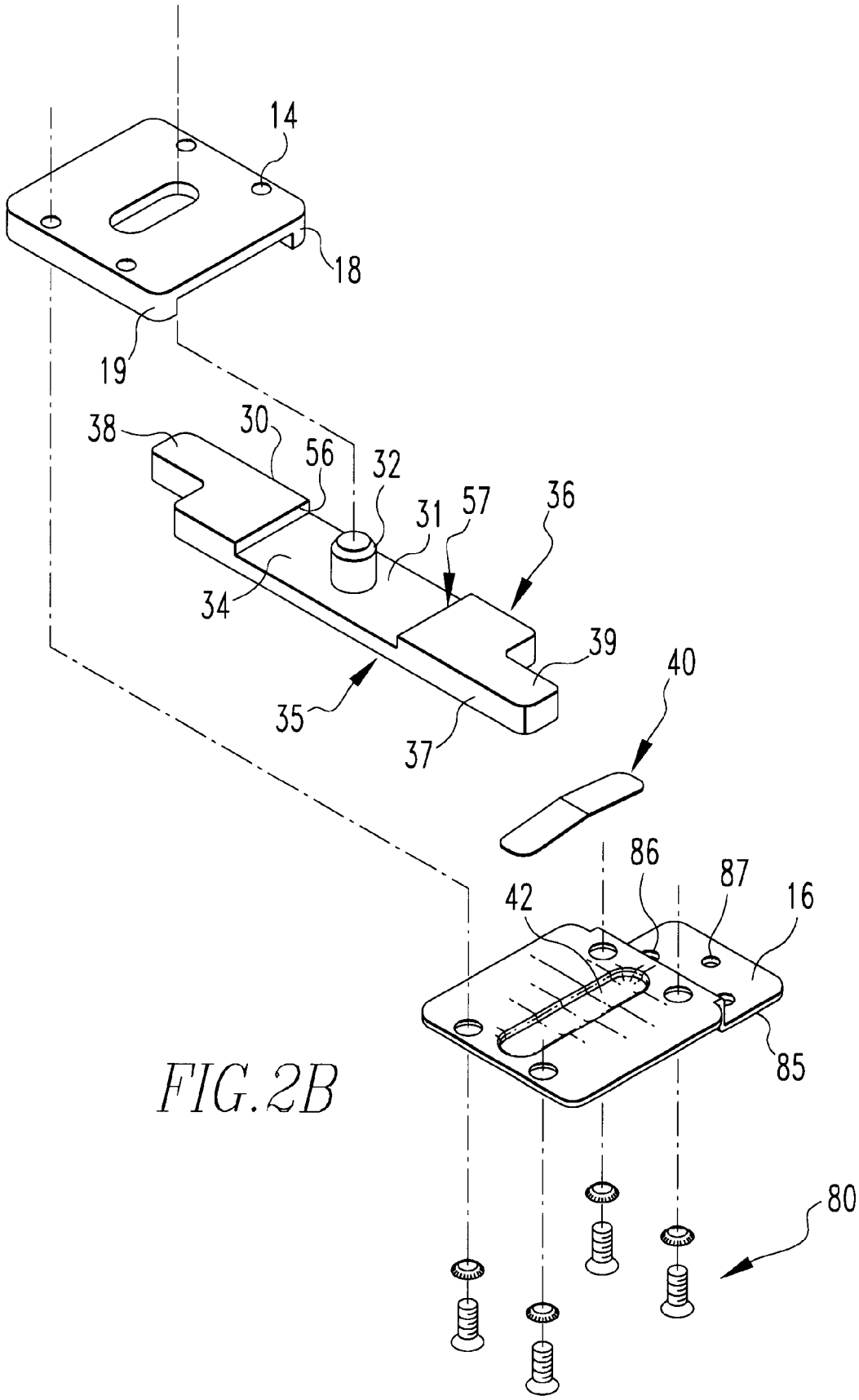

As shown in FIG. 2A, the interlock bar 30 has a center section 31, a projection 32, a front face 34, a rear face 35, an upper side 36, a lower side 37, a first arm 38, and a second arm 39. In the preferred embodiment, the interlock bar center section 31, first arm 38 and second arm 39 are straight. The projection 32 is attached to the front face 34. As shown in FIGS. 1 and 2A, when the interlock bar 30 is disposed within cavity 50, the first arm 38 extends through the first opening 52, the second arm 39 extends through the second opening 54, and the projection 32 extends through the slot 20. As shown in FIGS. 4A, 4B, 5A, and 5B, by moving the projection 32 from the first end 22 of the slot 20 to the second end 24 of the slot 20, the interlock bar 30 is moved from a first position 26 to a second position 28.

Figure 6:
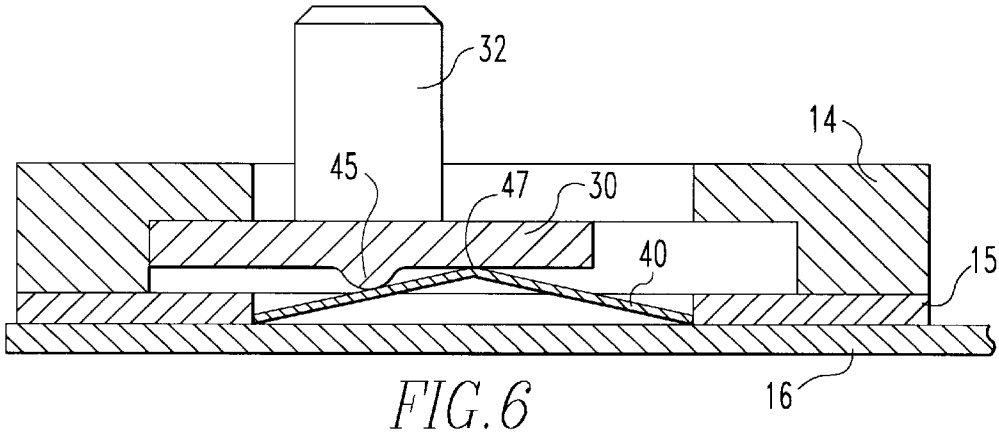
FIG. 6 shows a cross section of an alternate embodiment of the interlock assembly where the interlock bar has a rib.
Figure 7:
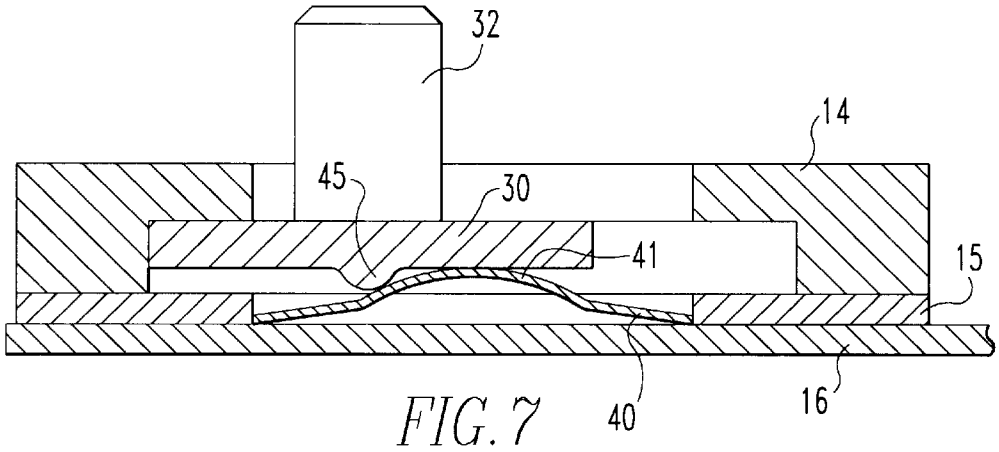
FIG. 7 shows a cross section of an alternate embodiment of the interlock assembly where the spring has a nib.

As shown in FIG. 2A, in the preferred embodiment, the interlock bar 30 is frictionally maintained in the first or second position 26, 28 by a spring 40 which is disposed between the interlock bar 30 and the back plate 16, thus biasing the interlock bar 30 against the face plate 14. In the preferred embodiment, there is an intermediate plate 15 which has a slot 43 therethrough which captures spring 40. The intermediate plate 15 is disposed between the interlock bar 30 and the back plate 16. However, in an alternate embodiment shown in FIG. 2B, the back plate 16 may have a recess 42 which maintains the spring 40 in its proper position. The spring 40 may be a V-shaped member disposed in the intermediate plate slot 43 with its vertex 47 contacting the interlock bar 30. As shown in FIG. 6, the interlock bar 30 may have a longitudinal rib 45 on the interlock bar rear face 35. The longitudinal rib 45 catches on the vertex 47 of the spring 40 to provide additional resistance when sliding the interlock bar 30. When the interlock bar 30 is in the first position 26 the rib 45 is disposed above the vertex 47. When the interlock bar 30 is in the second position 28 the rib 45 is disposed below the vertex 47. Alternatively, as shown in FIG. 7, the vertex 47 may have a nib 41 which assists in maintaining the interlock bar 30 in either the first or second position 26, 28.

Figure 8:
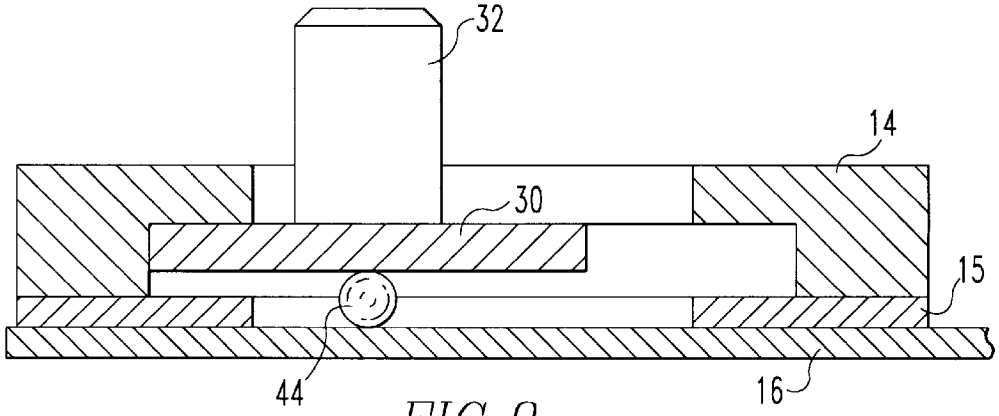
FIG. 8 shows a cross section of an alternate embodiment of the interlock assembly using a ball bearing.

As shown in FIG. 8, in an alternate embodiment, the interlock bar 30 is frictionally maintained in the first or second position 26, 28 by one or more ball bearings 44. As with the spring 40, the ball bearing 44 would be disposed between the interlock bar 30 and the back plate 16, biasing the interlock bar 30 against the face plate 14.

As shown in ghost in FIG. 3, in another embodiment, the interlock bar 30 is maintained in the first or second position 26, 28 by notches 46, 48 at the ends 22, 24 of the slot 20. The notches 46, 48 may be perpendicular to the slot 20, as shown with notch 48 or may be angled with respect to slot 20 so that gravity assists in maintaining the interlock bar 30 in position, as shown with notch 46.

To prevent the interlock bar 30 from rotating within the housing 12 about the projection 32, several means may be employed. As shown in FIGS. 1 and 2A, in the preferred embodiment, the first arm 38 and the second arm 39, are thicker than the center section 31 which is disposed within the housing cavity 50 and thicker than the first and second openings 52, 54. The first and second arms 38, 39 have bearing surfaces 56, 57 which contact the housing 12. The interface between the bearing surfaces 56, 57 and the housing 12 prevents the interlock bar 30 from rotating within the housing 12.

Figure 9:
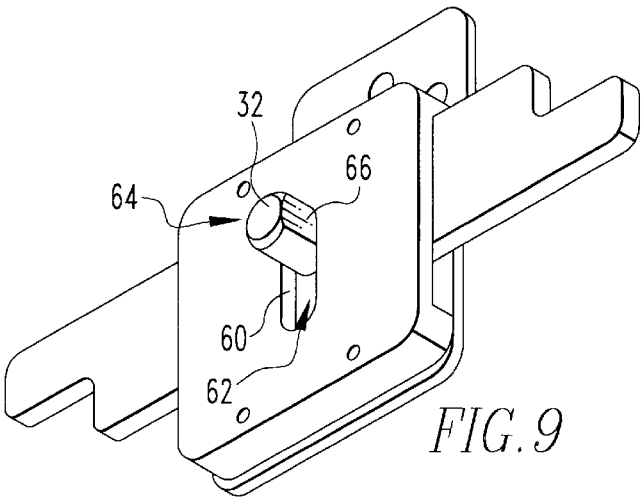
FIG. 9 shows an alternate embodiment of the interlock assembly using flattened projection.

As shown in FIG. 9, in an alternate embodiment, the projection 32 is cylindrical with flattened sides 64, 66. The slot 20 has bearing surfaces 60, 62 on its parallel sides. When the interlock bar projection 32 passes through the slot 20, the bearing surfaces 60, 62 contact the flat surfaces 64, 66. The contact between the bearing surfaces 60, 62 and the flat surfaces 64, 66 prevents rotation about the projection 32 of the interlock bar 30 in the housing 12.

Figure 10:
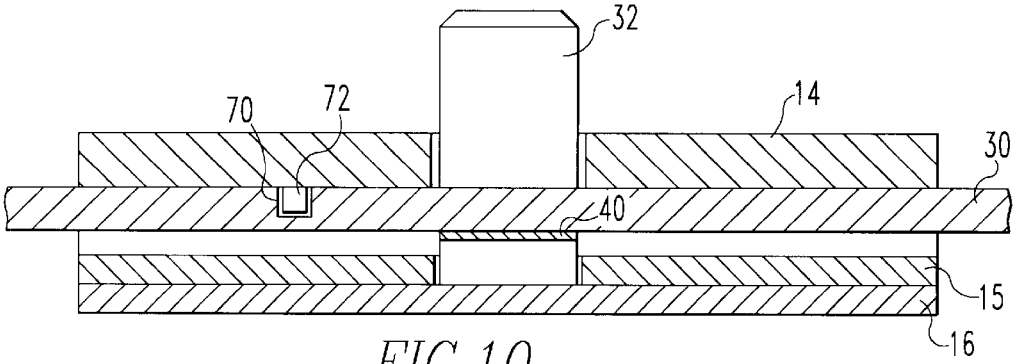
FIG. 10 shows an alternate embodiment of the interlock assembly using a projection and groove.

As shown in FIG. 10, in an alternate embodiment, the interlock bar 30 has a groove 70 running in the direction of travel of the interlock bar 30 in the housing 12. The face plate 14 has a extension 72 extending into the cavity 50. When the interlock bar 30 is disposed within the cavity 50, the face plate extension 72 extends into the grove 70. The groove 70 and extension 72 are spaced apart from the projection 32. If the interlock bar 30 begins to rotate about the projection 32, the extension 72 contacts a side of the groove 70. Thus, the contact between the groove 70 and the extension 72 prevents rotation of the interlock bar 30 in the housing 12.

Figure 11:
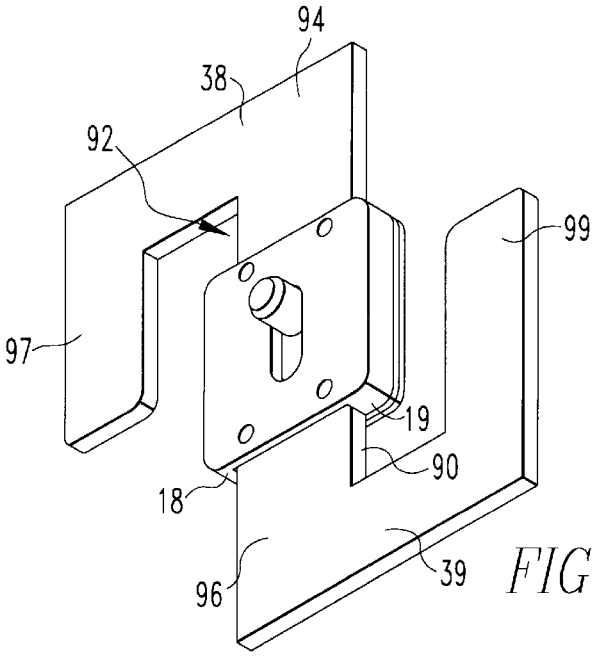
FIG. 11 shows another alternate embodiment.

As shown in FIG. 11 in another alternate embodiment, the slot 20 on the face plate 14 runs in a direction parallel to ends 18, 19. The interlock bar center section 31 has a right side 90, a left side 92 and terminates in a top end 94 and a bottom end 96. The right and left sides 90, 92 act as bearing surfaces contacting ends 18, 19 of the face plate 14. The top end 94 extends through the first opening 52 regardless of whether the interlock bar is in the first or second position 26, 28. The bottom end 96 extends through the second opening 54 regardless of whether the interlock bar is in the first or second position 26, 28. The first arm 38 extends from the left side 92 in a generally perpendicular direction of the top end 94. The second arm 39 extends from the right side 90 in a generally perpendicular direction of the bottom end 96. As before, the projection 32 extends through the slot 20 in the face plate 14. Rotation about the projection 32 is prevented by the contact between the right and left sides 90, 92 and ends 18, 19. The first arm 38 and the second arm 39 may have elongated perpendicular tips 97, 99.

Figure 12:
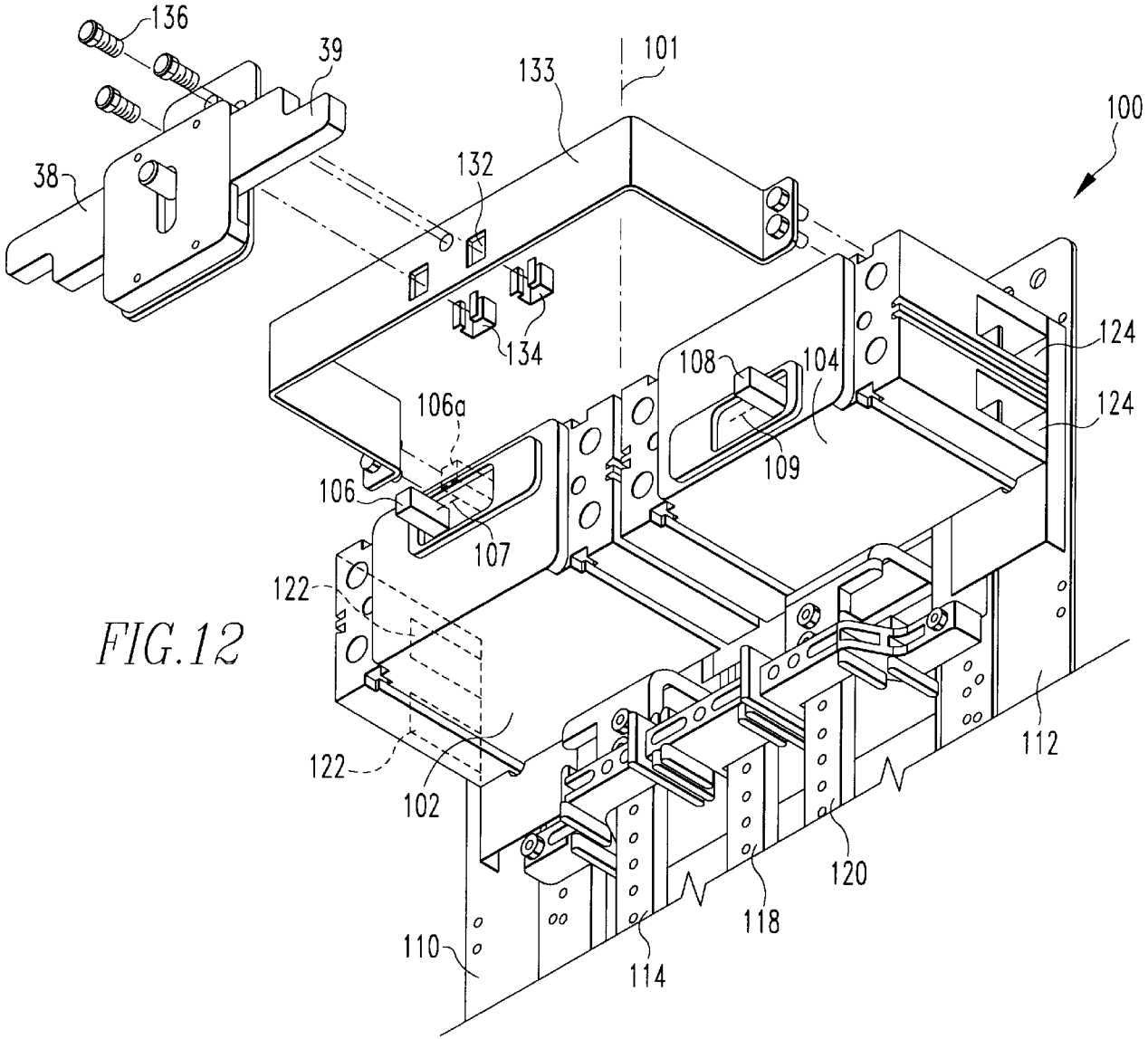
FIG. 12 shows the interlock assembly above circuit breakers mounted on a circuit breaker panel.

As shown in FIG. 12, a common circuit breaker 102, 104 is rectangular with a pivoting actuating handle 106, 108. The actuating handle 106, 108 typically runs in a direction parallel to the longer side of the rectangular circuit breaker 102, 104. The actuating handles 106, 108 each travel in a plane 107, 109 between a closed, operating position and an open, non-operating position.

First circuit breaker 102 and second circuit breaker 104 may be mounted in a circuit breaker panel 100 having a vertical centerline 101. The circuit breaker panel 100 has two frame members 110, 112 running vertically. Running parallel to and inside the frame members 110, 112 are terminal busses 114, 118 and 120. Circuit breaker 102 and circuit breaker 104 have power leads 122 (not shown) and 124 located on the side distal to the center line. Circuit breaker 102 can be coupled through power leads 122 to a normal power supply (not shown). Circuit breaker 104 is can be coupled through power leads 124 to an auxiliary power supply (not shown). The terminal busses 114, 118 and 120 are coupleable to a power-consuming load (not shown). First circuit breaker 102, is mounted to the left of the centerline 101 on frame member 110, and is connected to terminal buses 114, 118 and 120. Second circuit breaker 104 is mounted to the right of the centerline 101 on frame member 112 and is connected to terminal buses 114, 118 and 120. To save space in the circuit breaker panel 100, the terminal busses 114, 118, 120 and frame members 110, 112 run vertically, so that the circuit breakers 102, 104 may be mounted horizontally.

The circuit breakers 102, 104 are oriented such that the actuating handles 106, 108 are in the closed, operating position when each handle is proximal to the center line 101 of the circuit breaker panel 100. Thus, because the circuit breakers 102, 104 are mounted horizontally adjacent to each other, the circuit breaker handles 106, 108 are in the closed, operating position when the circuit breaker's handle, is proximal to the other circuit breaker. That is, as shown in FIG. 12 in ghost, the first circuit breaker 102 is in the closed, operating position when actuating handle 106*a* is to the right, proximal to the second circuit breaker 104. Conversely, the second circuit breaker 104 is in the closed, operating position when actuating handle 108 is to the left, proximal to the first circuit breaker 102.

A U-shaped bracket 130 is attached to frame members 110 and 112 adjacent to circuit breakers 102, 104. The housing 12 is disposed between circuit breakers 102, 104 and attached to the U-shaped bracket 133 by fasteners 136 passing through fastener holes 86, 87, 88 on the back plate tab 85. The fasteners 136 may pass through holes 132 in the bracket 130 and be received by self retaining nuts 134. The first arm 38, extends through the first opening 52 toward the first circuit breaker 102 and the second arm 39 extends through the second opening 54 toward the second circuit breaker 104. When interlock bar 30 is in the first position 26, the first arm 38 prevents the actuating handle 106 of the first circuit breaker 102 from being in the closed, operating position. When interlock bar 30 is in the second position 28, the second arm 39 prevents the actuating handle 108 of the second circuit breaker 104 from being in the closed, operating position. The interlock bar 30 may be slid within the housing 12 between the first position 26 and the second position 28. The plane of travel for the interlock bar 30 is perpendicular to the plane of travel for the actuating handles 106, 108.

Figure 4A:
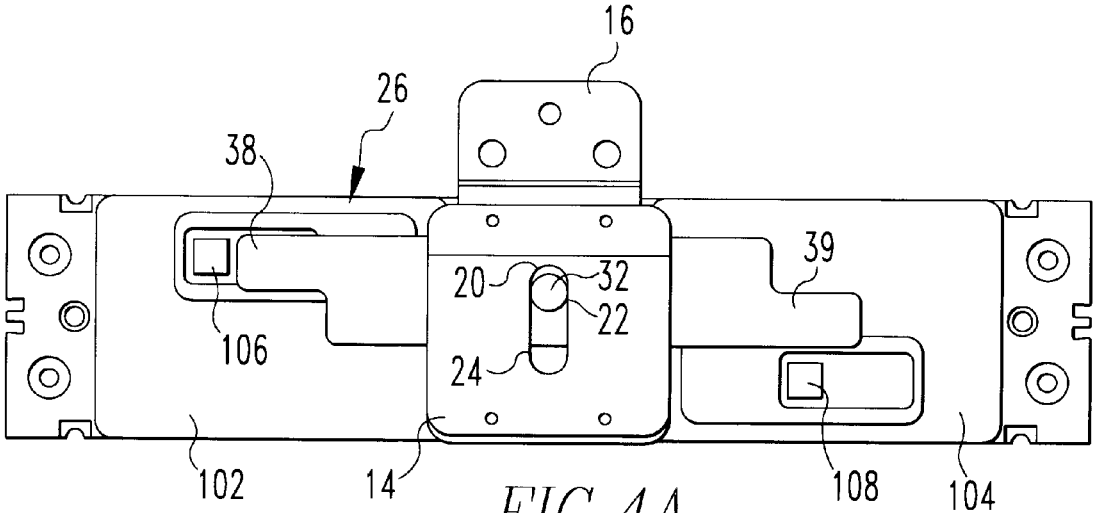
FIGS. 4A and 4B show a top view of the interlock assembly mounted above a pair of two-pole breakers, specifically, 4A shows the interlock assembly in a first position
Figure 4B:
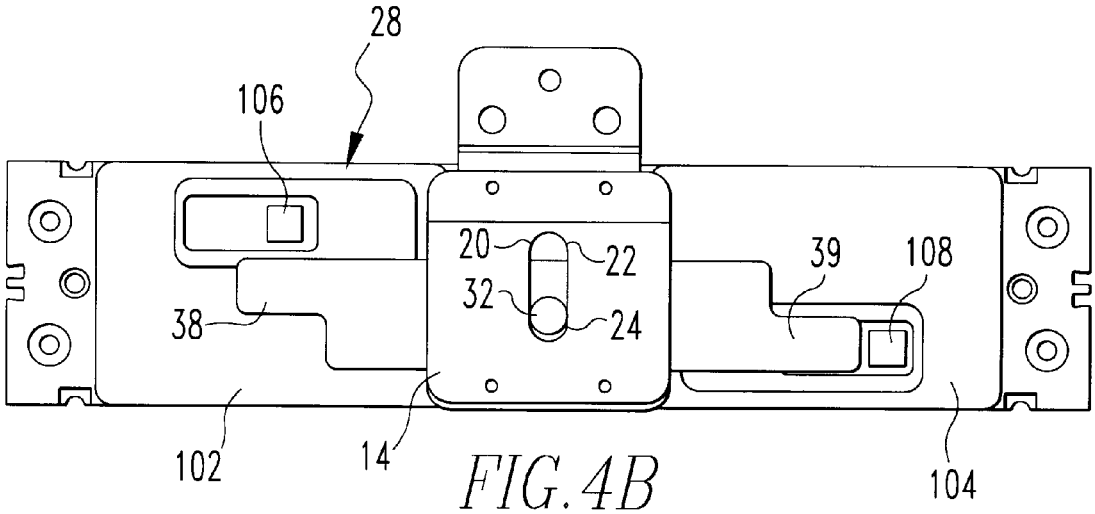

The interlock assembly 10 may be practiced with either one-pole circuit breakers, two-pole circuit breakers or three-pole circuit breakers. As shown in FIGS. 4A and 4B, the actuating handles 106, 108 of a pair of horizontally mounted two-pole breakers are offset so that they travel in different, but parallel, planes. As shown in FIG. 4A, when the interlock bar 30 is in the first position 26, the first arm 38 prevents the actuating handle 106 of the first circuit breaker 102 from being in the closed, operating position. Additionally, when the interlock bar 30 is in the first position 26, no part of the interlock bar is in the plane of travel of the actuating handle 108 of the second circuit breaker 104. Thus, the actuating handle 108 of the second circuit breaker 104 is free to be closed. When the actuating handle 108 of the second circuit breaker 104 is in the closed position, it prevents the interlock bar 30 from moving into the second position 28. Therefore, if the actuating handle 108 of the second circuit breaker 104 is in the closed position and operator wishes to move the interlock bar 30 from the first position 26 to the second position 28 so that the first circuit breaker 102 can be closed, the operator must open the second circuit 104, by moving actuating handle 108 into the open position. Once the actuating handle 108 of the second circuit breaker 104 is in the open position, the interlock bar 30 may be moved to the second position 28 and actuating handle 106 of the first circuit breaker 102 can be closed. Of course, when interlock bar 30 is in the second position 28, the second arm 39 prevents the actuating handle 108 of the second circuit breaker 104 from being in the closed, operating position.

Figure 5A:
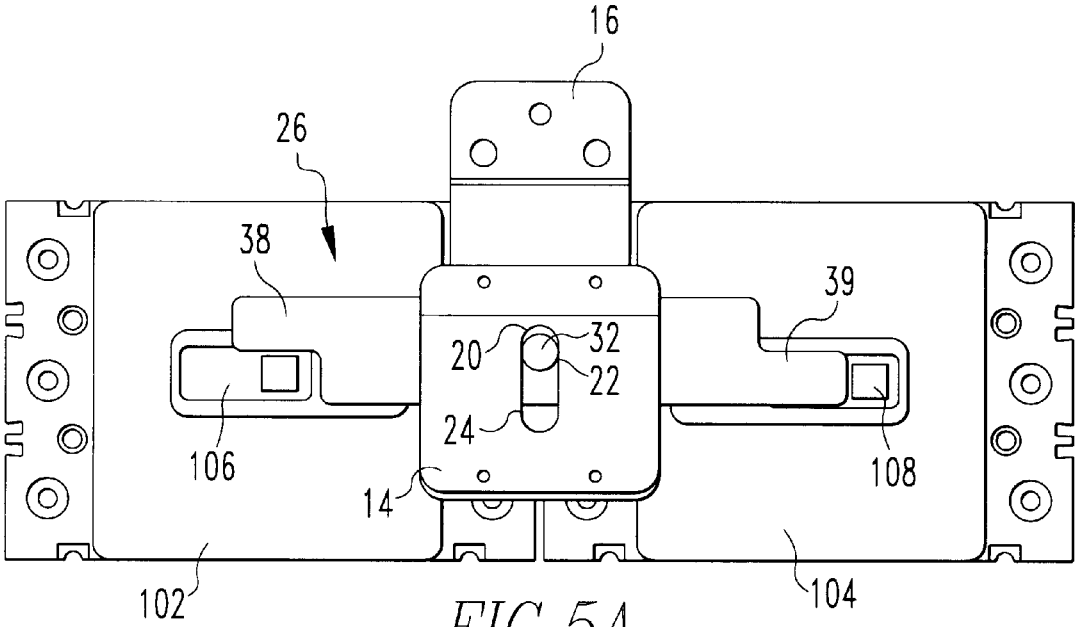
FIGS. 5A and 5B show a top view of the interlock assembly mounted above a pair of three-pole breakers, specifically, 5A shows the interlock assembly in a first position
Figure 5B:
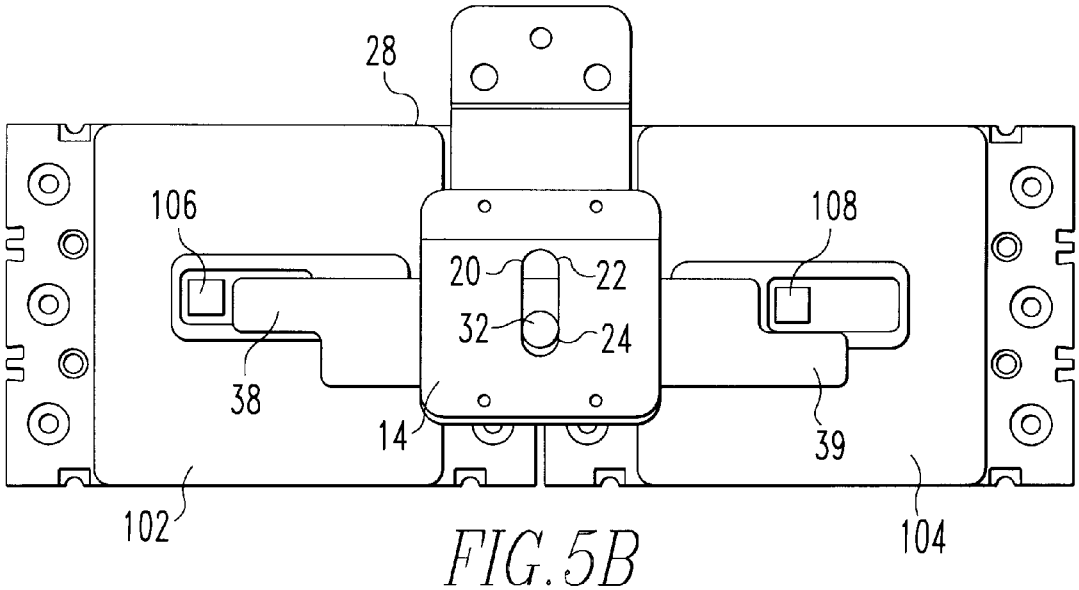

As shown in FIGS. 5A and 5B, the actuating handles 106, 108 of a pair of horizontally mounted three-pole breakers 102, 104 are aligned so that they travel within the same plane. One-pole breakers (not shown) also have horizontally aligned actuating handles. Because the actuating handles 106, 108 are aligned, the first and second arms of the interlock bar 38 must be laterally offset. The offset is of a sufficient length to allow the actuating handle 106 of the first circuit breaker 102 to be in the closed position when the interlock bar 30 is in the second position 28 and to allow the actuating handle 108 of the second circuit breaker 104 to be in the closed position when the interlock bar 30 is in the first position 26.

As shown in FIG. 5A, when the interlock bar 30 is in the first position 26, the first arm 38 prevents the actuating handle 106 of the first circuit breaker 102 from being in the closed, operating position. Additionally, while in the first position 26, the second arm 39 permits the actuating handle 108 of the second circuit breaker 104 to be in the closed position. When the actuating handle 108 of the second circuit breaker 104 is in the closed position, it prevents the interlock bar 30 from moving into the second position 28. Therefore, if the actuating handle 108 of the second circuit breaker 104 is in the closed position and operator wishes to move the interlock bar 30 from the first position 26 to the second position 28 so that the first circuit breaker 102 can be closed, the operator must open the second circuit 104, by moving actuating handle 108 into the open position. Once the actuating handle 108 of the second circuit breaker 104 is in the open position, the interlock bar 30 may be moved to the second position 28. Of course, when interlock bar 30 is in the second position 28, the second arm 39 prevents the actuating handle 108 of the second circuit breaker 104 from being in the closed, operating position and the first arm 38 allows the actuating handle 106 of the first circuit breaker 102 to be in the closed position.

The interlock bar 30 to be used with two-pole breakers does not need to be laterally offset. However, as shown in FIGS. 4A and 4B, a laterally offset interlock bar 30 can be used with a pair of two-pole breakers. Use of a single type of interlock bar will reduce manufacturing costs.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An apparatus for interlocking horizontally adjacent first and second circuit breakers and preventing the first and second circuit breakers from simultaneously being in a closed operating position, the circuit breakers each having a pivotable actuating handle movable within a plane between a closed operating position which is proximal to the other circuit breaker, and a open non-operating position which is distal to the other circuit breaker, said apparatus comprising:

a housing disposed between said first and second circuit breakers;

an interlock bar slidably retained in said housing;

said interlock bar having a first arm extending from said housing toward said first circuit breaker and a second arm extending from said housing toward said second circuit breaker; and said interlock bar being slidable between a first position where said first arm of said interlock bar prevents said first circuit breaker handle from pivoting into said closed position and a second position where said second arm of said interlock bar prevents said second breaker handle from pivoting into said closed position.

2. The apparatus of claim 1 wherein said interlock bar travels in a plane that is perpendicular to said actuating handle plane of travel.

3. The apparatus of claim 1 further including a means for securing said interlock bar in said first or said second position.

4. The apparatus of claim 3 wherein:

said means for securing said interlock bar in said first or second position comprises a spring disposed between said interlock bar and said housing biasing said interlock bar against said housing.

5. The apparatus of claim 4 wherein said interlock bar has a rear face;

said rear face having a longitudinal rib thereon;

said spring being a V-shaped spring having a vertex;

said longitudinal rib being above said vertex when said interlock bar is in said first position; and said longitudinal rib being below said vertex when said interlock bar is in said second position.

6. The apparatus of claim 4 wherein:

said housing includes a back plate and an intermediate plate having a slot; and said spring is disposed within said intermediate plate slot.

7. The apparatus of claim 4 wherein:

said housing includes a back plate having a recess; and said spring is disposed within said recess.

8. The apparatus of claim 3 wherein:

said means for securing said interlock bar in said first or second position comprises at least one ball bearing disposed between said interlock bar and said housing biasing said interlock bar against said housing.

9. The apparatus of claim 8 wherein:

said housing includes a back plate and an intermediate plate having a slot; and said at least one ball bearing is disposed within said slot.

10. The apparatus of claim 8 wherein:

said housing includes a back plate having a recess; and said at least one ball bearing is disposed within said recess.

11. The apparatus of claim 3 wherein said housing includes a face plate having a slot therethrough, said interlock bar having a projection through said face plate slot, and said means for securing said interlock bar in said first or second position comprises at least one notch on said face plate slot.

12. The apparatus of claim 3 further comprising a means for preventing said interlock bar from rotating in said housing.

13. The apparatus of claim 12 wherein said means for preventing said interlock bar from rotating in said housing comprises:

said housing has a first and second opening;

said first arm extends from said first opening;

said second arm extends from said second opening;

said interlock bar has a center portion within said housing connecting said first and second arms;

said first and second arms are thicker than said center portion;

said first and second arms having bearing surfaces contacting said housing.

14. The apparatus of claim 12 wherein said means for preventing said interlock bar from rotating in said housing comprises:

said interlock bar having a projection;

said housing comprises:

a U-shaped face plate, having generally perpendicular ends and a medial slot therethrough;

said projection having at least one flat surface;

said face plate slot having at least one bearing surface;

said projection disposed with said projection flat surface contacting said face plate slot bearing surface.

15. The apparatus of claim 12 wherein said means for preventing said interlock bar from rotating in said housing comprises:

said interlock bar having a projection;

said housing comprises:

a U-shaped face plate, having generally perpendicular ends and a medial slot therethrough;

said face plate having a extension;

said interlock bar having a groove running in the direction of travel between said first position and said second position;

said extension projecting into said groove.

16. The apparatus of claim 12 wherein said means for preventing said interlock bar from rotating in said housing comprises:

said interlock bar having an top end and a bottom end;

said bottom end having a right side;

said top end having a left side;

said first arm extending perpendicularly from said top end left side;

said second arm extending perpendicularly from said bottom end right side; and said interlock bar having a projection;

said housing comprises:

a U-shaped face plate, having generally perpendicular ends and a medial slot therethrough;

said right and left sides contacting said ends of said U-shaped face plate.

17. The apparatus of claim 1 wherein:

said interlock bar includes a projection;

said housing comprises:

a U-shaped face plate, having generally perpendicular ends and a medial slot therethrough;

a back plate;

said U-shaped face plate is attached to said back plate with said ends contacting said back plate and said interlock bar is disposed between said U-shaped face plate and said back plate, with said projection extending through said slot on said face plate.

18. The apparatus of claim 17, wherein said interlock bar first arm and said second arm are laterally offset.

19. An apparatus comprising:

a pair of circuit breakers, each having a pivoting actuating handle;

a housing disposed between said circuit breakers;

an interlock bar slidably mounted in said housing;

said pivoting actuating handles being pivotable within first and second parallel planes;

said handles each having a closed position and an open position;

said circuit breakers oriented so that said closed position of each said circuit breaker handle is proximal to other said circuit breaker and said open position of each said circuit breaker handle is distal to other said circuit breaker;

said interlock bar being slidable in a plane that is perpendicular to said first and second planes between a first position in which said interlock bar blocks the pivoting actuating handle of one circuit breaker from being in said closed position and a second position in which said interlock bar blocks the pivoting actuating handle of the other circuit breaker from being in said closed position.

20. An apparatus comprising:

a circuit breaker panel board having a vertical center line;

a first circuit breaker having a first pivoting actuating handle, said first pivoting handle movable within a first plane between a closed, operating position and an open, non-operating position;

a second circuit breaker having second pivoting actuating handle, said second pivoting handle movable within a second plane between a closed, operating position and an open, non-operating position;

said first circuit breaker being mounted horizontally adjacent to said second circuit breaker on said opposite sides of said panel board center line;

said first and second planes being parallel to each other;

said first circuit breaker oriented so that said closed position of said first pivoting actuating handle is proximal to said second circuit breaker and said open position of said first pivoting actuating handle is distal to said second circuit breaker;

said second circuit breaker oriented so that said closed position of said second pivoting actuating handle is proximal to said first circuit breaker and said open position of said second pivoting actuating handle is distal to said first circuit breaker;

a housing disposed between said circuit breakers;

a interlock bar slidably mounted in said housing;

said interlock bar being slidable in a plane that is perpendicular to said first and second planes between a first position, in which said interlock bar prevents said first circuit breaker actuating handle from being in said closed position, and a second position, in which said interlock bar prevents said second circuit breaker actuating handle from being in said closed position.

21. The apparatus of claim 20 wherein:

said interlock bar includes a first arm extending from said housing adjacent said first circuit breaker and a second arm extending from said housing adjacent said second circuit breaker;

said first arm blocks operation of said first circuit breaker in said first position and said second arm blocks operation of said second circuit breaker in said second position.

22. The apparatus of claim 21 further including a means for securing said interlock bar in said first or said second position.

23. The apparatus of claim 22 wherein:

said means for securing said interlock bar in said first or second position comprises a spring disposed between said interlock bar and said housing biasing said interlock bar against said housing.

24. The apparatus of claim 23 wherein said interlock bar has a rear face;

said rear face having a longitudinal rib thereon;

said spring being a V-shaped spring having a vertex;

said longitudinal rib being above said vertex when said interlock bar is in said first position; and said longitudinal rib being below said vertex when said interlock bar is in said second position.

25. The apparatus of claim 23 wherein:

said housing includes a back plate and an intermediate plate having a slot; and said spring is disposed within said intermediate plate slot.

26. The apparatus of claim 23 wherein:

said housing includes a back plate having a recess; and said spring is disposed within said recess.

27. The apparatus of claim 22 wherein:

said means for securing said interlock bar in said first or second position comprises at least one ball bearing disposed between said interlock bar and said housing biasing said interlock bar against said housing.

28. The apparatus of claim 27 wherein:

said housing includes a back plate and an intermediate plate having a slot; and said at least one ball bearing is disposed within said intermediate plate slot.

29. The apparatus of claim 27 wherein:

said housing includes a back plate having a recess; and said at least one ball bearing is disposed within said recess.

30. The apparatus of claim 22 wherein said housing includes a face plate having a slot therethrough, said interlock bar having a projection through said face plate slot, and said means for securing said interlock bar in said first or second position comprises at least one notch on said face plate slot.

31. The apparatus of claim 21 further comprising a means for preventing said interlock bar from rotating in said housing.

32. The apparatus of claim 31 wherein said means for preventing said interlock bar from rotating in said housing comprises:

said housing has a first and second opening;

said first arm extends from said first opening;

said second arm extends from said second opening;

said interlock bar has a center portion within said housing connecting said first and second arms;

said first and second arms are thicker than said center portion;

said first and second arms having bearing surfaces contacting said housing.

33. The apparatus of claim 32 wherein said means for preventing said interlock bar from rotating in said housing comprises:

said interlock bar having a projection;

said housing comprises:

a U-shaped face plate, having generally perpendicular ends and a medial slot therethrough;

said projection having at least one flat surface;

said face plate slot having at least one bearing surface;

said projection disposed with said projection flat surface contacting said face plate slot bearing surface.

34. The apparatus of claim 32 wherein said means for preventing said interlock bar from rotating in said housing comprises:

said interlock bar having a projection;

said housing comprises:

a U-shaped face plate, having generally perpendicular ends and a medial slot therethrough;

said face plate having a extension;

said interlock bar having a groove running in the direction of travel between said first position and said second position;

said extension projecting into said groove.

35. The apparatus of claim 32 wherein said means for preventing said interlock bar from rotating in said housing comprises:

said interlock bar having an top end and a bottom end;

said bottom end having a right side;

said top end having a left side;

said first arm extending perpendicularly from said top end left side;

said second arm extending perpendicularly from said bottom end right side; and said interlock bar having a projection;

said housing comprises:

a U-shaped face plate, having generally perpendicular ends and a medial slot therethrough;

said right and left sides contacting said ends of said U-shaped face plate.

36. The apparatus of claim 21 wherein:

said interlock bar includes a projection;

said housing comprises:

a U-shaped face plate, having generally perpendicular ends and a medial slot therethrough;

a back plate;

said U-shaped face plate is attached to said back plate with said ends contacting said back plate and said interlock bar is disposed between said U-shaped face plate and said back plate, with said projection extending through said slot on said face plate.

37. The apparatus of claim 36, wherein said circuit breakers are three-pole breakers and said interlock bar first end and said second end are laterally offset.

38. The apparatus of claim 21 wherein said circuit breaker panel comprises;

a frame having at least two parallel members;

said first circuit breaker coupleable to a normal power source;

said second circuit breaker coupleable to an auxiliary power source;

at least two busses coupleable to a power-consuming load;

said circuit breakers attached to at least one said frame member.

39. The circuit breaker interlock apparatus of claim 37 further comprising:

a U-shaped bracket attached at either end to each said frame members adjacent said first and second circuit breakers;

said back plate attached to said U-shaped bracket.

40. The circuit breaker interlock apparatus of claim 39 further comprising:

self-retaining nuts;

said U-shaped bracket includes fastener holes therethrough;

said self-retaining nuts are disposed in said U-shaped bracket fastener holes.

* * * * *